US006205924B1

(12) United States Patent
Kamano

(10) Patent No.: US 6,205,924 B1
(45) Date of Patent: Mar. 27, 2001

(54) SHEET UNLOADING APPARATUS

(75) Inventor: Tadao Kamano, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,979

(22) Filed: Oct. 25, 1999

(30) Foreign Application Priority Data

Oct. 27, 1998 (JP) ..... 10-305463

(51) Int. Cl.[7] ..... B41F 47/14

(52) U.S. Cl. ..... 101/477; 101/409; 271/82; 271/307

(58) Field of Search ..... 400/644; 101/409, 101/246, 477, 415.1; 271/307, 308, 311, 312, 82

(56) References Cited

U.S. PATENT DOCUMENTS

| | | | | |
|---|---|---|---|---|
| 1,515,791 | * | 11/1924 | Redner | 101/409 |
| 4,401,382 | * | 8/1983 | Minejima et al. | 271/307 |
| 5,296,874 | * | 3/1994 | Nagata et al. | 400/644 |
| 5,323,699 | * | 6/1994 | Mutoe et al. | 101/477 |
| 5,553,543 | * | 9/1996 | Takahashi et al. | 101/409 |
| 5,623,871 | * | 4/1997 | Takahira | 101/477 |
| 5,802,434 | * | 9/1998 | Takehara et al. | 171/308 |

FOREIGN PATENT DOCUMENTS

| | | |
|---|---|---|
| 10-138520 | 5/1998 | (JP) . |
| 10-186867 | 7/1998 | (JP) . |
| 10-193719 | 7/1998 | (JP) . |
| 10-329375 | 12/1998 | (JP) . |

* cited by examiner

*Primary Examiner*—Eugene Eickholt
(74) *Attorney, Agent, or Firm*—Frishauf, Holtz, Goodman, Langer & Chick, P.C.

(57) ABSTRACT

A sheet unloading apparatus is used for rotary drum rotatable in one direction along with a paper sheet which is wound around a peripheral surface of the rotary drum and at rear end mechanically engaged in an engagement groove formed in the peripheral surface. The sheet unloading apparatus includes a separation paws for separating a front end of the paper sheet from the rotary drum by contacting the peripheral surface of the rotary drum while the rotary drum rotates in the one direction, and a pair of pinch rollers for rotating to pinch and feed out the paper sheet supplied according to the rotation of the rotary drum in a state where the front end of the paper sheet is separated from the rotary drum by the separation pawl and the rear end of the paper sheet is engaged in the engagement groove. Particularly, the unloading apparatus further include a removal assisting mechanism for assisting the paper sheet to be pulled out from the engagement groove by bending the paper sheet spanning between the rotary drum and the pair of pinch rollers.

4 Claims, 2 Drawing Sheets

SHEET UNLOADING APPARATUS

BACKGROUND OF THE INVENTION

The present invention relates to a sheet unloading apparatus for a rotary drum rotatable in one direction along with a sheet which is wound around a peripheral surface of the rotary drum.

Jpn. Pat. Appln. KOKAI Publication No. 10-138520 discloses a rotary drum ink-jet printer which can print a large number of pages in a short period of time. The rotary drum ink-jet printer comprises a rotary drum rotatable in one direction and a print head for printing an image on a paper sheet wound around the rotary drum and rotated along with the rotary drum. The print head has a plurality of ink-jet nozzles arranged in a line across a paper sheet in the axial direction of the rotary drum. The print head jets ink through the ink-jet nozzles to the paper sheet which moves relative to the print head as the rotary drum rotates. This structure allows high-speed print, since it does not require that the print head move across the paper sheet as in the conventional serial ink-jet printer.

In general, a paper sheet is held on the rotary drum by a combination of vacuum attraction, electrostatic attraction, mechanical engagement, etc. Jpn. Pat. Appln. KOKAI Publication No. 10-193719 discloses a technique of mechanically engaging the front and rear ends of an externally supplied paper sheet on the peripheral surface of a rotary drum to prevent positional deviation of the paper sheet. According to this technique, engagement grooves are formed in the peripheral surface of the rotary drum at positions corresponding to the front and rear ends of the paper sheet. The front and rear ends of the paper sheet are engaged in the engagement grooves by clamping claws. The technique of engaging the rear end of a paper sheet is also disclosed in Jpn. Pat. Appln. KOKAI Publication No. 10-329375.

In the rotary drum ink-jet printer, at the time of unloading the paper sheet, the front end of a paper sheet is separated from the drum by a separation pawl which is brought into contact with the rotary drum, and then guided to a pair of pinch rollers. These pinch rollers are disposed near the rotary drum to pinch the front end of the paper sheet in a state where the rear end thereof is engaged in the engagement groove, and rotate in one direction at the same circumferential speed as the circumferential speed of the rotary drum to feed out the pinched paper sheet.

However, since the shapes of the engagement grooves and the rigidity of the paper sheet are determined to gain sufficient sheet holding force, it is possible that the rear end of the paper sheet may not be removed from the engagement groove by the sheet pulling force of the pinch rollers. If the rotary drum is further rotated together with the paper sheet whose the rear end is engaged in the engagement groove, the paper sheet will be pulled out of the pinch rollers in the reverse direction and wound around the rotary drum inside out, causing a paper jam. This problem can be overcome by increasing the rotation speed of the pinch rollers. However, since the paper sheet is easily waved by shock resulting from a difference in circumferential speed between the rotary drum and the pinch rollers, it is necessary to change the circumferential speed of the pinch rollers after the rear end of the paper sheet passes by the print head for printing an image on the paper sheet. This change of speed requires a complicated structure for a pinch roller driving circuit, resulting in an increase in cost, restriction on the layout and an increase in power consumption. Further, it is not easy to determine the optimal speed of the pinch rollers, which provides sheet pulling force slightly greater than the sheet holding force on the rotary drum. If the shape of the engagement grooves, such as the depth or the slope angle, or the rigidity of the paper sheet is to be changed, the optimal speed must be reset in accordance with such a change.

BRIEF SUMMARY OF THE INVENTION

An object of the present invention is to provide a sheet unloading apparatus which can reliably unload a sheet from the rotary drum without being considerably affected by holding force for holding the sheet on the rotary drum.

According to the present invention, there is provided a sheet unloading apparatus for a rotary drum rotatable in one direction along with a sheet which is wound around a peripheral surface of the rotary drum and at rear end mechanically engaged in an engagement groove formed in the peripheral surface, comprising: a separation pawl for separating a front end of the sheet from the rotary drum by contacting the peripheral surface of the rotary drum while the rotary drum rotates in the one direction; and a pair of pinch rollers for rotating to pinch and feed out the sheet supplied according to rotation of the rotary drum in a state where the front end of the sheet is separated from the rotary drum by the separation pawl and the rear end of the sheet is engaged in the engagement groove, the sheet unloading apparatus further comprising a removal assisting mechanism for assisting the sheet to be pulled out from the engagement groove by bending the sheet spanning between the rotary drum and the pair of pinch rollers.

In the sheet unloading apparatus, the removal assisting mechanism assists the sheet to be pulled out from the engagement groove by bending the sheet spanning between the rotary drum and the pair of pinch rollers. In this case, the sheet pulling force can be increased without requiring an increase in the circumferential speed of the pinch rollers. Such sheet pulling force has less dependence on the sheet holding force of holding the sheet on the rotary drum than in the case where the circumferential speed of the pinch rollers is changed. Therefore, the sheet can be reliably separated from the rotary drum without being considerably affected by the sheet holding force.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A rotary drum ink-jet printer according to an embodiment of the present invention will be described with reference to the accompanying drawings.

Figure 1:
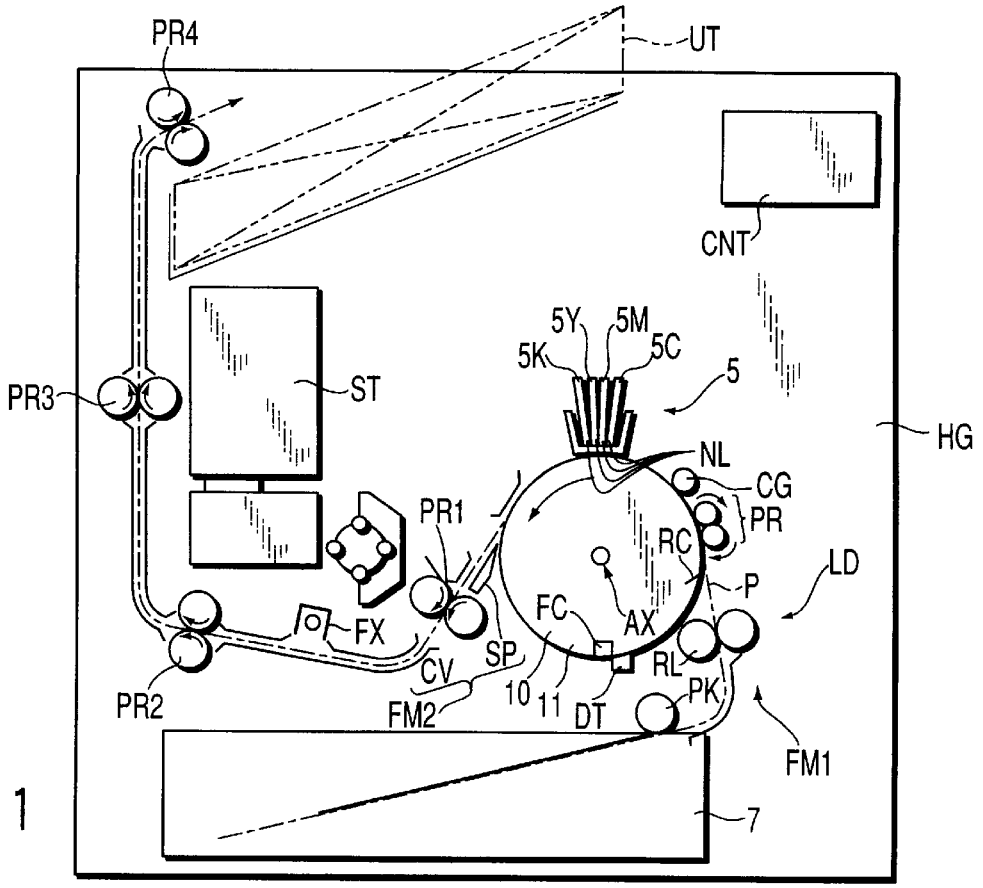
FIG. 1 is a diagram showing an internal structure of a rotary drum ink-jet printer according to an embodiment of the present invention.

FIG. 1 shows an internal structure of the rotary drum ink-jet printer. The ink-jet printer is used to print a multicolored image on a print medium such as a paper sheet P obtained by cutting plain paper into a sheet.

The ink-jet printer comprises a paper cassette 7 for storing a stack of paper sheets P, a rotary drum 10 rotatable in a direction R at a constant circumferential speed, a rotational position detector DT for detecting a rotational position of the rotary drum 10, a sheet feed-in mechanism FM1 for feeding the paper sheet P from the paper cassette 7 to the rotary drum 10, a print head 5 for printing a multicolored image on the paper sheet P held by and rotated along with the rotary drum 10, a sheet feed-out mechanism FM2 for feeding out the paper sheet P which has been printed while being held on the rotary drum 10, and a control unit CNT for controlling the operations of all components of the ink-jet printer.

Figure 2:
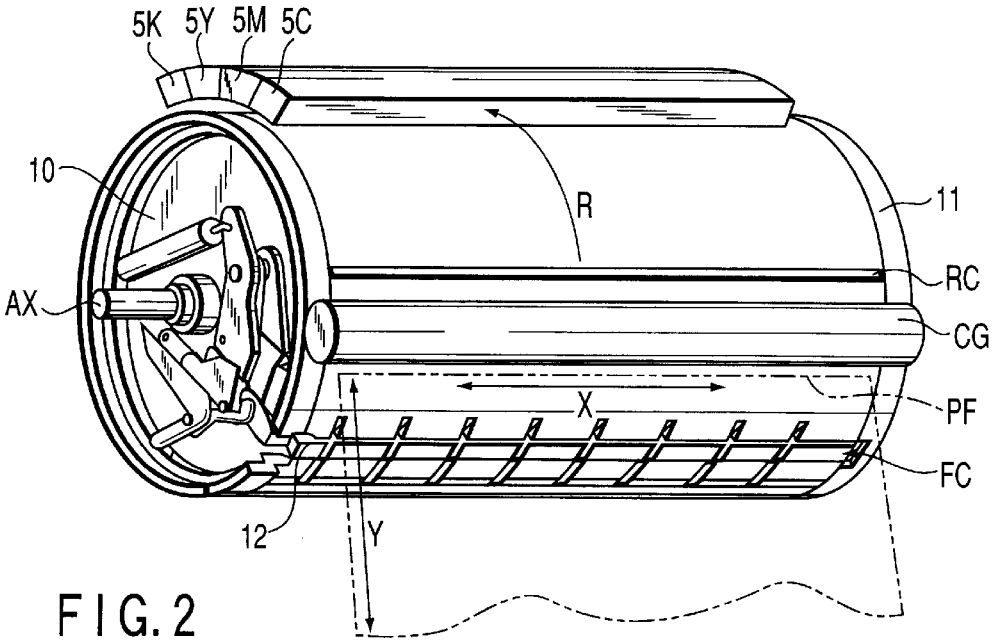
FIG. 2 is a diagram showing a positional relationship between the rotary drum and the print head shown in FIG. 1.

As shown in FIG. 1, the rotary drum 10 is located near the central position inside a housing HG. The print head 5 is located above the rotary drum 10. The paper cassette 7 is located under the rotary drum 10. The rotational position detector DT is located at a position close to a peripheral surface 11 of the rotary drum 10. The rotary drum 10 is supported so as to be rotatable about an axis AX, as shown in FIG. 2, and holds a paper sheet P wound around the peripheral surface 11.

The sheet feed-in mechanism FM1 has a pickup roller PK for picking up a paper sheet P from the paper cassette 7, and a sheet loader LD for loading the paper sheet P picked up by the pickup roller PK onto the rotary drum 10. The sheet loader LD has a pair of pinch rollers RL which rotate while pinching the paper sheet P. The sheet loader LD is controlled by the control unit CNT such that loading of the paper sheet P is initiated when the rotary drum 10 is detected to be arrived at a predetermined position by the rotational position detector DT. The control unit CNT includes a CPU, a ROM, a RAM, I/O ports and various driving circuits in order to control all the components.

Figure 3:
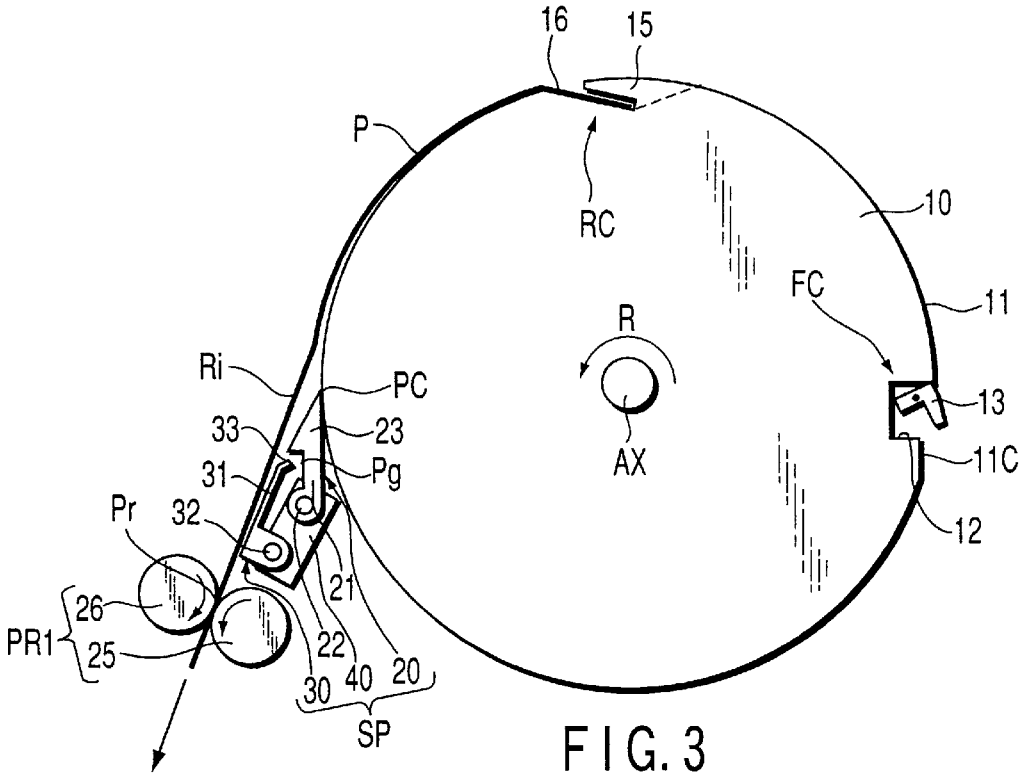
FIG. 3 is a diagram showing a sheet separating operation of the sheet separator shown in FIG. 1.

As shown in FIG. 1, the ink-jet printer further comprises a charge roller CG located at a position close to the peripheral surface 11 of the rotary drum 10 between the sheet loader LD and the print head 5 in order to apply electrostatic charge to the paper sheet P loaded on the peripheral surface 11 of the rotary drum 10. To prevent positional deviation of the paper sheet P held on the peripheral surface 11 of the rotary drum 10 by electrostatic attraction, the ink-jet printer comprises a front end engagement mechanism FC and a rear end engagement mechanism RC for mechanically engaging the front and rear ends of the paper sheet P on the peripheral surface 11 of the rotary drum 10. As shown in FIG. 3, the front end engagement mechanism FC has a recess 12 formed in the peripheral surface 11 of the rotary drum 10 and a clamping claw 13 rotatable in the recess 12 to clamp a front end PF of the paper sheet P on a holding surface 11C. The rear end engagement mechanism RC has an engagement groove 15 formed in the peripheral surface 11 of the rotary drum 10, and a pair of engagement assisting rollers RR located at a position close to the peripheral surface 11 of the rotary drum 10 between the charge roller CG and the sheet loader LD, as shown in FIG. 1. These assisting rollers RR rotate in different rotation speeds and are temporarily brought into contact with the paper sheet P to insert the rear end of the paper sheet P through an opening 16 into the engagement groove 15. Since the rear end of the paper sheet P is tucked in the engagement groove 15 sloped from the peripheral surface 11 toward an axis AX side portion of the rotary drum 10, the paper sheet P is not easily slipped on the peripheral surface 11 or lifted up from the peripheral surface 11.

The print head 5 has four nozzle units 5C, 5M, 5Y and 5K arranged in series along the peripheral surface 11 of the rotary drum 10 from the upstream side to the downstream side in order to print an image with color inks of cyan (C), magenta (M), yellow (Y) and black (K) supplied from an ink supply section ST. Each of the nozzle units 5C, 5M, 5Y and 5K has a plurality of ink-jet nozzles NL which are arranged in the axial direction of the rotary drum 10 to have a span corresponding to the width of the paper sheet P of, for example, A4 size and jet the ink of the corresponding color to the paper sheet P. The print head 5 is capable of being reciprocated or shifted by 1/75 inch in a main scanning direction X parallel to the axial direction of the rotary drum 10. The rotary drum 10 holds the paper sheet P wound around the peripheral surface 11, and rotates to move the paper sheet P in a sub-scanning direction Y perpendicular to the main scanning direction X, while the paper sheet P is facing the nozzle units 5C, 5M, 5Y and 5K. The rotation speed of the rotary drum 10 is kept constant, for example, 120 rpm; that is, the rotary drum 10 makes one revolution per 0.5 second. In a printing process, the print head 5 is shifted in the main scanning direction X at a constant rate of 1/2 nozzle pitch PT, each time the rotary drum 10 makes one rotation. Accordingly, the print head moves by a distance equal to the nozzle pitch PT while the drum rotates twice.

The sheet feed-out mechanism FM2 includes a sheet separator SP which is located downstream from the print head 5 along the peripheral surface 11 of the rotary drum 10 to separate the paper sheet P printed by the print head 5 from the rotary drum 10, and a feeding conveyor CV for conveying the paper sheet P separated by the sheet separator SP to a discharge tray UT. The feeding conveyor CV has a plurality of feeding roller sections PR1, PR2, PR3 and PR4 arranged along a conveying path connecting the sheet separator SP and the discharge tray UT. Each of the feeding roller sections PR1, PR2, PR3 and PR4 has a pair of pinch rollers which rotate at the same circumferential speed as the circumferential speed of the rotary drum 10. A drier FX is also arranged on the conveying path to fix the ink on the paper sheet P.

The clamping claw 13 of the front end engagement mechanism FC is released, while the paper sheet is moving from the position of the print head 5 to the position of the sheet separator SP after the printing.

As shown in FIG. 3, the sheet separator SP has a separation pawl 20 which is brought into contact with the peripheral surface 11 of the rotary drum 10 to separate the front end of the paper sheet P from the drum; a removal guide plate 30 for assisting the paper sheet P from being pulled out from the engagement groove 15 by bending the paper sheet P spanning between the separation pawl 20 and the feeding roller section PR1, and a driving mechanism 40 for driving the separation pawl 20 and the removal guide plate 30. The separation pawl 20 has a pivot 22, an arm member 21 rotatable about the pivot 22, and a tapered distal end member 23 extending from the arm member 21, and is arranged such that the distal end member 23 is brought into contact with the peripheral surface 11 of the rotary drum 10 when the separation pawl 20 is driven. The removal guide plate 30 has a pivot 32, a main guide 31 rotatable about the pivot 32 and an auxiliary guide 33 extending from the main guide 31, and is arranged between a sheet separating position Pc where the distal end member 23 of the separation pawl 20 contacts the peripheral surface 11 of the rotary drum 10 and a sheet pinching position Pr where the pinch rollers 25 and 26 of the feeding roller section PR1 pinch the paper sheet P. The pivot 22 of the separation pawl 20 and the pivot 32 of the removal guide plate 30 are coupled to the single driving mechanism 40 and driven in association with each other. The driving mechanism 40 has a rotary driving mechanism constituted by, for example, a decelerating gear mechanism, a motor, etc., or a link driving mechanism constituted by a solenoid, a link, etc. The driving mechanism 40 is controlled by the control unit CNT to operate at a predetermined timing with reference to the rotational position of the rotary drum 10.

After the paper sheet P is printed by the print head 5, it is moved toward the sheet separating position Pc by the rotation of the rotary drum 10. During this movement, the separation pawl 20 is set to an active position where the distal end member 23 is brought into contact with the peripheral surface 11 of the rotary drum 10, as shown in FIG. 3. At this time, the removal guide plate 30 is set to a standby position, which defines a sheet feeding route Rj linearly connecting the sheet separating position Pc and the sheet pinching position Pr. The front end of the paper sheet P is separated from the peripheral surface 11 of the rotary drum 10 by the separation pawl 20 at the sheet separating position Pc, and linearly guided along the removal guide plate 30 to the sheet pinching position Pr. When the pinch rollers 25 and 26 of the feeding roller section PR1 pinch the front end of the paper sheet P which has arrived at the sheet pinching position Pr, the rear end of the paper sheet P is still engaged in the engagement groove 15 on the peripheral surface 11 of the rotary drum 10.

Figure 4:
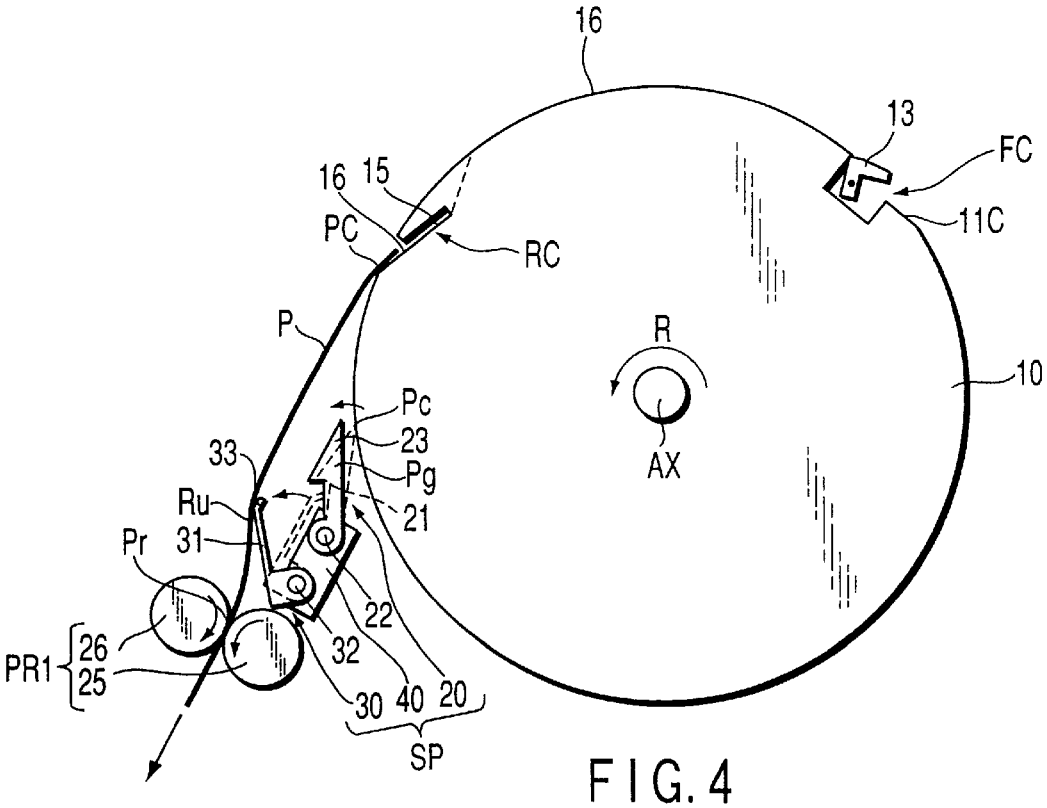
FIG. 4 is a diagram showing a sheet-removal assisting operation of the sheet separator shown in FIG. 1.

While the rear end of the paper sheet P is moved from the position of the print head 5 to the sheet separating position Pc by the rotation of the rotary drum 10, the removal guide plate 30 is pivoted up from the standby position, and, as shown in FIG. 4, set to an active position, defining a sheet detour route Ru to bend the paper sheet P spanning between the rotary drum 10 and the feeding roller section PR1. At this time, the separation pawl 20 is pivoted up from the active position and set to a standby position where it is not in contact with any of the paper sheet P and the rotary drum 10.

When the removal guide plate 30 is pivoted up from the standby position to the active position, since the paper sheet P is pinched by the pinch rollers 25 and 26, the sheet feeding speed is temporarily increased as the paper sheet P bends. The increase in the feeding speed acts as additional sheet pulling force applied to the rear end of the paper sheet P engaged in the engagement groove 15, thereby assisting the paper sheet to be pulled out by the pinch rollers 25 and 26. Throughout this operation, the pinch rollers 25 and 26 are kept at the circumferential speed equal to that of the rotary drum 10. The sheet detour route Ru may be set to be closer to the rotary drum 10 than the sheet feeding route Rj or remoter from the rotary drum 10 than the sheet feeding route Rj. In the ink-jet printer of this embodiment, the sheet detour route Ru is set to be remoter from the rotary drum 10 than the sheet feeding route Rj, in order to obtain separating force for separating the paper sheet P from the rotary drum 10 against the electrostatic attraction.

The removal guide plate 30 may be constructed so as to be rotated about the pivot 21 of the separation pawl 20. However, it is not preferable that the separation pawl 20 in the form described above be used as the removal guide plate 30 which is in contact with the rear surface of the paper sheet P slid thereon. More specifically, since the distal end member 23 of the separation pawl 20 has an acute angle to reliably separate the paper sheet P from the peripheral surface 11 of the rotary drum 10, the paper sheet P may be damaged when the distal end member 23 is pivoted up to bend the paper sheet P. Therefore, it is preferable that the removal guide plate 30 be formed to an arc shape, independent of the separation pawl 20. In this embodiment, the removal guide plate 30 has a substantially arc shape by the combination of the guides 31 and 33.

The control unit CNT of the ink-jet printer performs a control for simultaneously rotating the separation pawl 20 and the removal guide plate 30. However, for example, the control may be changed so as to switch the removal guide plate 30 from the standby position to the active position a predetermined time (e.g., 0.5 second) before or after the timing of switching the separation pawl 20 from the active position to the standby position. The control unit CNT is constructed so that it can adjust in advance the rotation speed of the removal guide plate 30 which is a factor of defining the switching time required for switching from the standby position to the active position, and a rotation angle of the removal guide plate 30 which is a factor of defining the standby position and the active position. However, the rotation speed and the rotation angle can be changed by adjusting the driving mechanism 40 or adjusting the guide length of the removal guide plate 30. The sheet pulling force applied to the paper sheet P is increased in proportion to the amount of route shift corresponding to the rotation angle and the guide length of the removal guide plate 30. If the amount of route shift is constant, the sheet pulling force is increased in proportion to the rotation speed of the removal guide plate 30.

According to this embodiment, when the removal guide plate 30 is pivoted up to the active position, the paper sheet P is bent so as to be fed in the sheet detour route Ru longer than the sheet feeding route Rj. Due to the shift of the route, the distance of sheet feed per unit time is temporarily increased. Accordingly, satisfactory sheet pulling force for pulling out the rear end of the paper sheet P from the engaging groove 15 can be obtained by shortening the time required for switching the sheet feeding route Rj to the sheet detour route Ru, without switching the rotation speed of the pinch rollers 25 and 26 to a higher speed.

Further, the above embodiment has a simple structure in which the sheet separator SP rotates the removal guide plate 30 located between the rotary drum 10 and the feeding roller section PR1. The manufacturing cost required for reliably pulling out the rear end of the paper sheet P from the engaging groove 15 can be reduced. In addition, since the removal guide plate 30 has a substantially arc shape by the combination of the guides 31 and 33, even if the removal guide plate 30 is brought into contact to with the paper sheet P spanning between the rotary drum 10 and the feeding roller section PR1, the paper sheet P can be protected from being damaged. Therefore, the feeding route of the paper sheet P can be changed smoothly.

Further, the separation pawl 20 and the removal guide plate 30 are driven in association with each other by the driving mechanism 40. Therefore, the sheet separator SP can be more compact and manufactured at a lower cost as compared to the case where a plurality of individual driving mechanisms are provided to drive the separation pawl 20 and the removal guide plate 30.

Furthermore, the sheet separator SP is constructed to bend the paper sheet P, which is entirely held on the peripheral surface 11 of the rotary drum 10 by electrostatic attraction with the rear end thereof being engaged in the engaging groove 15 of the rotary drum 10, to a side away from the peripheral surface 11 of the rotary drum 10. Therefore, the sheet separator SP can provide separating force for separating the paper sheet P from the rotary drum 10 against the electrostatic attraction. Accordingly, if satisfactory sheet pulling force which acts on the paper sheet P is obtainable, the electrostatic attraction can be increased in accordance with the separating force, thereby reliably preventing the paper sheet P from lifting off during a print process.

In the above embodiment, the present invention is applied to the ink-jet printer. However, it can be also applied to an apparatus other than printers, such as an image processing apparatus or a facsimile apparatus in which a sheet is held on a rotary drum.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet unloading apparatus for a rotary drum rotatable in one direction along with a sheet which is wound around a peripheral surface of said rotary drum and at rear end mechanically engaged in an engagement groove formed in the peripheral surface, comprising:

a separation pawl for separating a front end of the sheet from said rotary drum by contacting the peripheral surface of said rotary drum while said rotary drum rotates in said one direction;

a pair of pinch rollers for rotating to pinch and feed out the sheet supplied according to rotation of said rotary drum in a state where the front end of the sheet is separated from said rotary drum by said separation pawl and the rear end of the sheet is engaged in said engagement groove; and a removal assisting mechanism for assisting the sheet to be pulled out from said engagement groove by bending the sheet spanning between said rotary drum and said pair of pinch rollers.

2. A sheet unloading apparatus according to claim 1, wherein the removal assisting mechanism includes a removal guide plate selectively switched between a standby position and an active position, the standby position defining a sheet feeding route connecting a sheet separating position where the sheet is separated from the rotary drum and a sheet pinching position where the sheet is pinched by said pair of pinch rollers, and the active position defining a sheet detour route to bend the sheet on the sheet feeding route.

3. A sheet unloading apparatus according to claim 2, wherein the removal assisting mechanism includes a driving mechanism for driving the separation pawl and the removal guide plate in association with each other.

4. A sheet unloading apparatus according to claim 2, wherein the sheet detour route is set to be remoter from the rotary drum than the sheet feeding route when the sheet is held on the rotary drum by electrostatic attraction.

* * * * *